US008221256B2

(12) United States Patent
Broering

(10) Patent No.: US 8,221,256 B2
(45) Date of Patent: Jul. 17, 2012

(54) GOLF SWING PRACTICE BOARD AND METHOD OF USE

(76) Inventor: Gerald A. Broering, St. Henry, OH (US)

( * ) Notice: Subject to any disclaimer, the term of this patent is extended or adjusted under 35 U.S.C. 154(b) by 0 days.

(21) Appl. No.: 12/357,217

(22) Filed: Jan. 21, 2009

(65) Prior Publication Data

US 2009/0215548 A1 Aug. 27, 2009

Related U.S. Application Data

(60) Provisional application No. 61/022,108, filed on Jan. 18, 2008, provisional application No. 61/094,432, filed on Sep. 5, 2008.

(51) Int. Cl.
*A63B 69/36* (2006.01)

(52) U.S. Cl. ..... 473/220; 473/265; 473/278

(58) Field of Classification Search ..... 473/219, 473/220, 223, 225, 257, 261, 262, 264, 265, 473/266, 268, 270, 278, 422
See application file for complete search history.

(56) References Cited

U.S. PATENT DOCUMENTS

| | | | | |
|---|---|---|---|---|
| 3,350,101 | A * | 10/1967 | Bishop et al. | 473/265 |
| 4,915,387 | A * | 4/1990 | Baxstrom | 473/218 |
| 5,759,110 | A * | 6/1998 | Seibel et al. | 473/220 |
| 5,788,582 | A | 8/1998 | Shapiro | |
| 5,860,871 | A | 1/1999 | Marley, Jr. | |
| 5,954,592 | A | 9/1999 | Laffer et al. | |
| 6,001,026 | A * | 12/1999 | Breneman | 473/261 |
| 6,059,668 | A * | 5/2000 | Marley, Jr. | 473/220 |
| 6,227,982 | B1 | 5/2001 | Wurster | |
| 7,077,765 | B2 | 7/2006 | Grossmeyer et al. | |
| 7,131,910 | B2 * | 11/2006 | Townsend, II | 473/278 |
| 2003/0114237 | A1 * | 6/2003 | Boatner | 473/220 |
| 2003/0190972 | A1 * | 10/2003 | Townsend, II | 473/278 |
| 2005/0090323 | A1 * | 4/2005 | Kellogg | 473/218 |
| 2007/0173339 | A1 * | 7/2007 | Rivard | 473/266 |

OTHER PUBLICATIONS

Golf Swing Training Aid, Reviews and Advice, Butch Harmon Laser Trainer www.golfswingtrainingaid.com/butch-harmon-laser-trainer.php.

Golf training aids, Golfer's Footprint, Hitting Mat http://www.dwquailgolf.com/training/golfersfootprint.html.

* cited by examiner

*Primary Examiner* — Nini Legesse
(74) *Attorney, Agent, or Firm* — Renner, Otto, Boisselle & Sklar, LLP

(57) ABSTRACT

A golf swing training system and method includes a golf club, a light connected to or incorporated in the golf club, and a graphical display upon which a light is projected when a golfer swings the club. The graphics include various markings that indicate foot position and that can be observed to generate the desired golf swing. The golfer moves the clubhead and then the light along a first line until the light reaches a point at the top of the golfer's backswing. As the golfer begins the downswing, a third line provides a visual indication of the orientation of the club shaft at a midpoint of the downswing, when the shaft is parallel to the ground, and then the golfer swings the clubhead to impact the ball on plane and square to the target line, and other markings indicate foot position.

1 Claim, 24 Drawing Sheets

GOLF SWING PRACTICE BOARD AND METHOD OF USE

I claim the benefit of U.S. Provisional Patent Application Nos. 61/022,108, filed Jan. 18, 2008, and 61/094,432 , filed Sep. 5, 2008, both of which are incorporated herein by reference.

FIELD OF THE INVENTION

My invention relates to a golf swing training system, and more particularly to a system incorporating a golf swing practice board and a methods for using it.

BACKGROUND

In the game of golf, a golf club is swung at a stationary ball with the aim of advancing the ball toward a target. The golf swing includes a backswing, where the club is drawn back away from the ball and upward, and then a downswing where the club is brought back down and toward the ball. A golf club generally has a shaft with a grip at a butt end and a large clubhead at an opposite end with an approximately planar face for striking the ball. In a successful golf swing, when the club strikes the ball it generally should be perpendicular to the direction to the target. This is referred to as squaring the clubface or hitting on plane, the plane referred to being a plane within which the club moves on the downswing to strike the ball with the clubface square to the target line.

Golfers often expend a lot of time and effort in developing a golf swing that consistently squares the clubface at impact. During the golf swing a golfer's hips, shoulders, hands, and arms, all move at the same time as the golfer brings the clubhead back and then down to impact with the golf ball. To develop a consistent golf swing, several training systems and methods have been developed. Some include a light source associated with a golf club, such as a laser, that shines toward and beyond the clubhead, and a device that shows a preferred path for the light beam and/or the clubhead as the club is swung.

SUMMARY

My invention is for a golf swing training system and associated method that helps a golfer learn to set up on plane, move through the backswing on plane, move through the downswing on plane, and strike the ball on plane and square to the target line in a consistent and repeatable manner.

One of the concepts provided by the present invention is a golf swing training system having a golf club grip and a light source that can be connected to or incorporated in the golf club grip, and a graphical display with markings upon which light from a light source can be projected when a golfer swings the grip through a desired swing path. Prior golf swing training devices failed to include all of the features provided by my invention. Some of these features include a top-of-the-swing indicator, foot position markings, a line for keeping the club on plane at the start of the downswing, the ability to hit golf balls off of it, and the ability to fold up the training device and easily move it from place to place and store it in a compact configuration.

The foregoing and other features of the invention are hereinafter fully described and particularly pointed out in the claims, the following description and annexed drawings setting forth in detail a certain illustrative embodiment of the invention, this embodiment being indicative, however, of but one of the various ways in which the principles of the invention may be employed.

DETAILED DESCRIPTION

My invention is for a golf swing training system and associated method that helps a golfer learn to set up on plane, move through the backswing on plane, move through the downswing on plane, and strike the ball on plane and square to the target line in a consistent and repeatable manner. My system provides numerous checkpoints for the golfer to check whether the club is on plane at multiple points spread throughout the swing.

An exemplary system includes a golf club grip or a complete golf club and a light source that can be connected to or incorporated in the golf club grip, and a graphical display upon which a light from the light source is projected when a golfer swings the grip. The graphical display includes various markings that can be used to generate the desired golf swing. Typically the grip is part of a golf club, but it is not necessary. An exemplary light source is a focused flashlight or a laser, such as a laser pointer, that can be attached to or inserted in the butt or grip end of the shaft to shine a light aligned with the shaft and pointing away from the clubhead.

Figure 1:
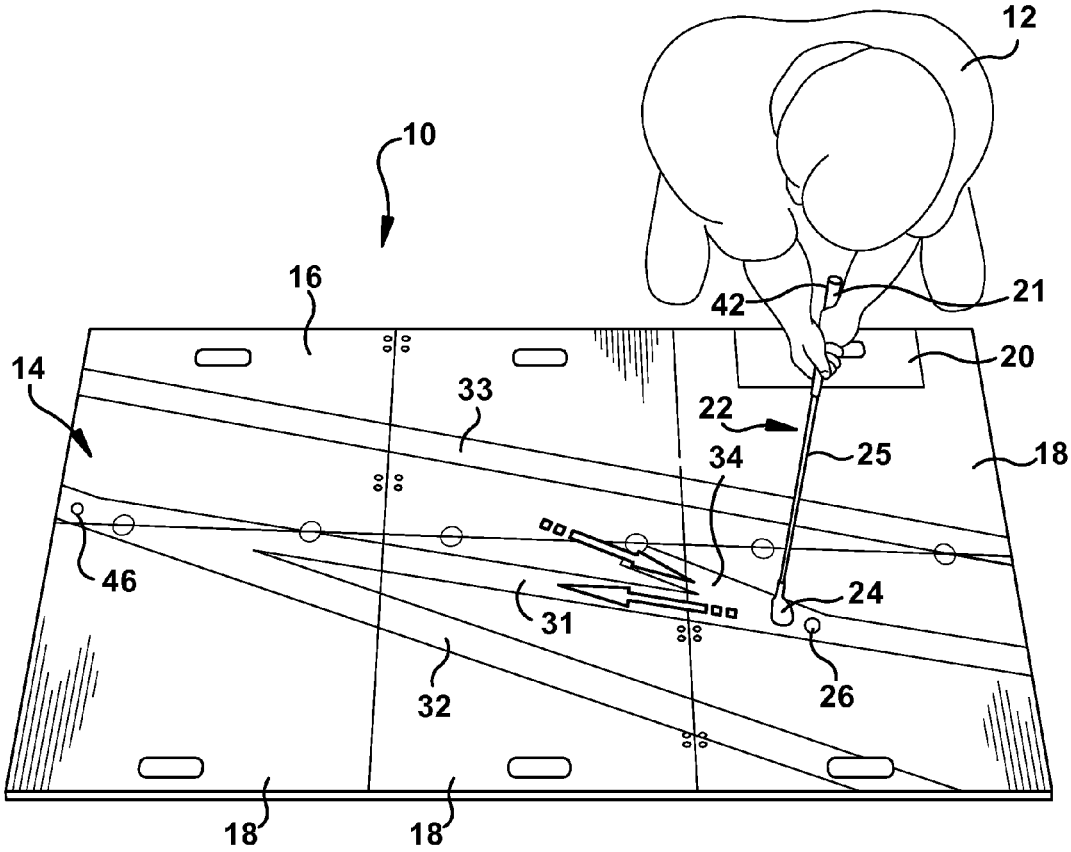
FIG. 1 is an overhead perspective view of a golf swing training board provided as part of an exemplary golf swing training system.

Referring now to the drawings, in FIG. 1 I show one example of a training system 10 that embodies the concepts behind my invention. The drawings show a golfer 12 generally, for purposes of illustration only. In this system, the graphical display 14 is presented on a board 16 or mat. Alternatively, the graphical information may be produced on the ground or otherwise placed within the golfer's field of view. The display can include different colors and patterns to distinguish different markings.

Figure 2:
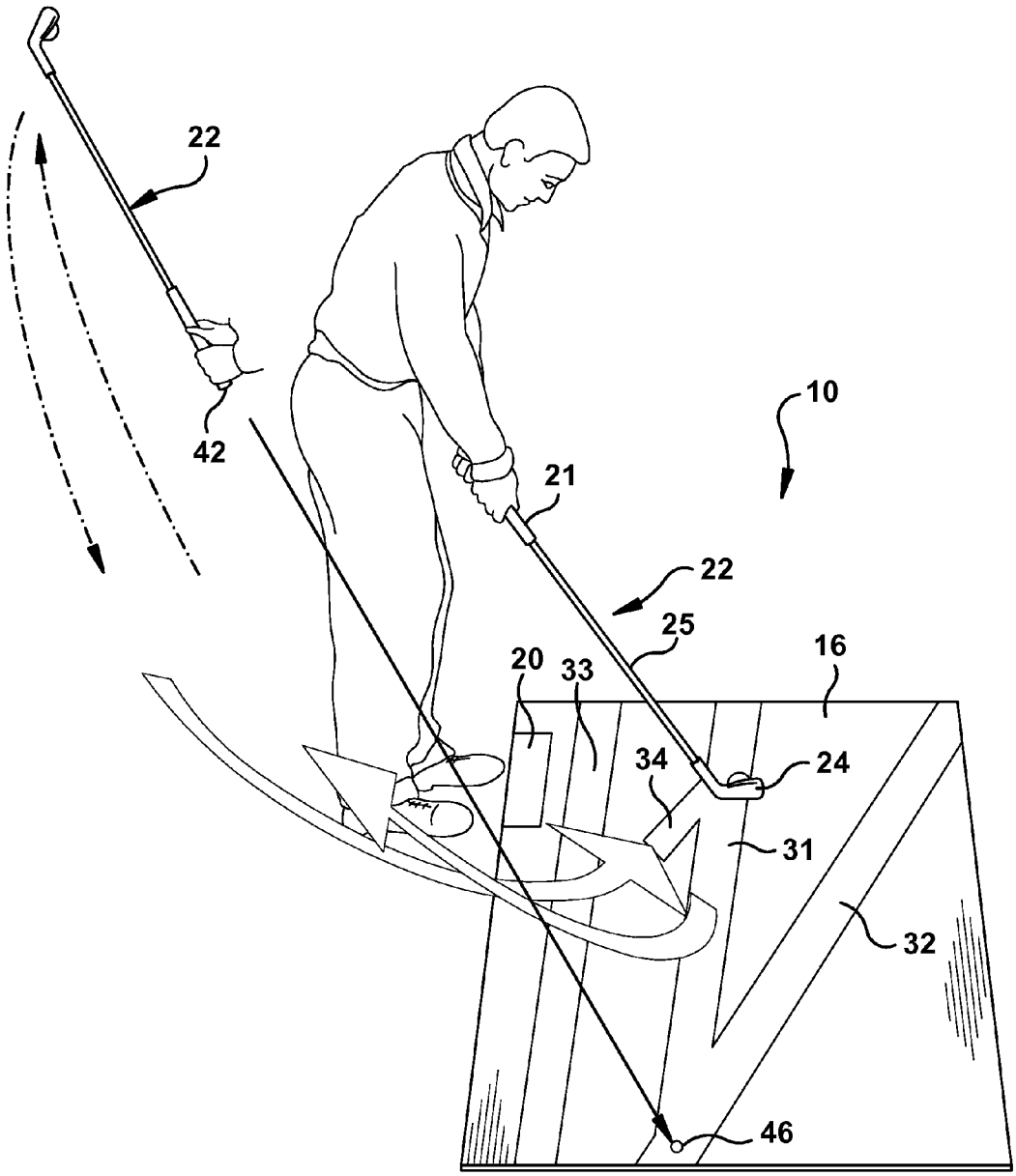
FIG. 2 is a side perspective view of a golf swing training board provided as part of an exemplary golf swing training system.

The board 16 shown in FIG. 1 is made up of six segments or panels 18 that are connected by hinges so that the board can be laid flat and can be folded up, making it easier to transport to a practice area and put away for storage out of the weather. Alternatively a one-piece board or mat may be used, as shown in FIG. 2.

The board 16 includes marking to indicate where the golfer should place his feet. To begin, a golfer stands to one side of the board 16 with his feet spaced on either side of the box 20 and extends his arms in a typical setup position with his hands on the grip 21 of the club 22 and the clubhead 24, on the opposite end of the shaft 25 from the grip 21, placed behind a ball and/or a ball mark 26. In place of the illustrated box 20, the board 16 may have separate marks that indicate the proper placement for each foot. The ball mark 26 indicates the position of a ball, and can include a recess or a through-hole or to receive a golf tee, either of which can help to keep a ball in place until struck. A ball can be set on the ball mark 26 and the clubhead 24 set behind the ball, or the golfer can practice without a ball. To simplify the description, the terms ball and ball mark will be used interchangeably. The board 16 also includes several lines, referred to as a first line 31, second line 32, third line 33, and fourth line 34 that help guide the path of a golf club relative to the ball mark 26 during a golf swing.

As I mentioned above, to help track the position of the club 22 during a portion of the swing the system 10 includes a laser pointer or other light source 42. The light source 42 is arranged to direct light in a direction away from the clubhead and generally toward the golfer at a setup or address position. The light preferably is aligned to shine in line with the shaft 25 of the club 22, but alternatively can project in a line parallel to the shaft.

Before I address the particulars of how the markings are used, notice that the clubhead 24 travels back along the first line 31 during the backswing, and then comes back along the fourth line 34 on the downswing, the fourth line 34 being inclined to the first line 31 on the inside, the side closer to the golfer. This is because the backswing is on a steeper plane than the downswing, which when combined with the golfer turning his body serves to keep the clubface on plane, particularly at impact.

Figure 3:
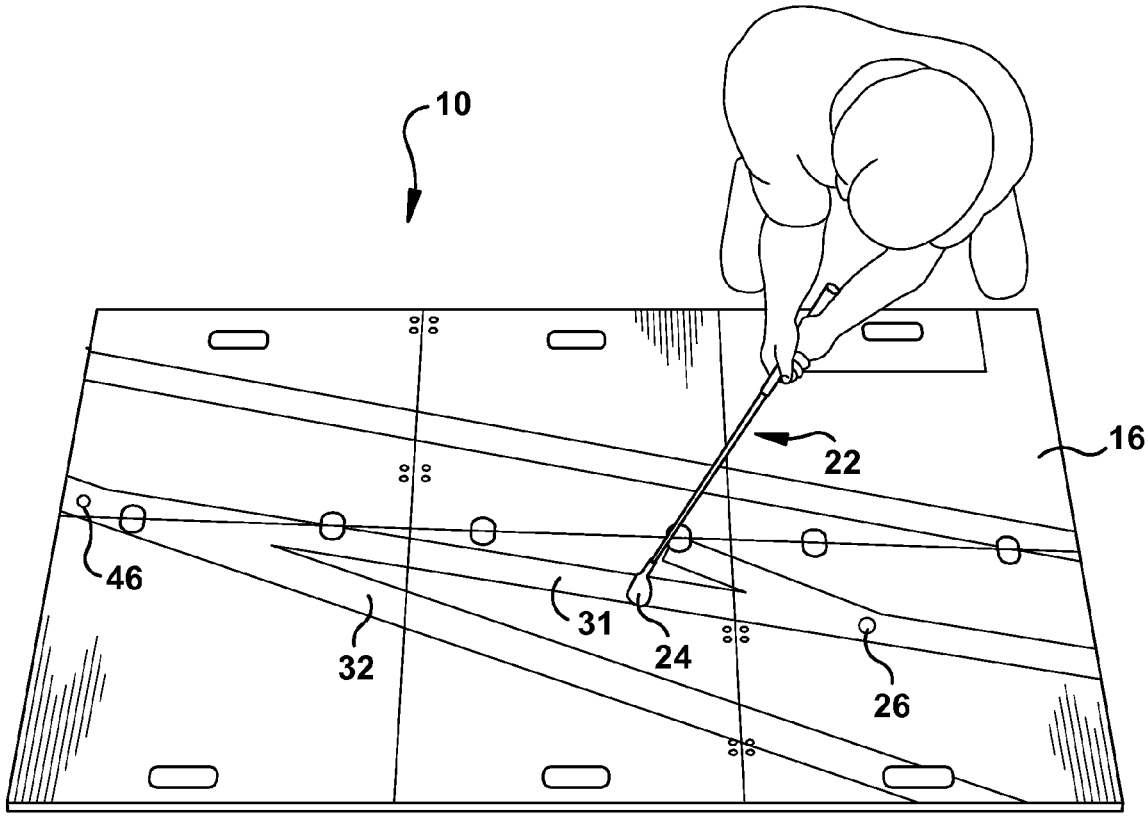
FIGS. 3-7 are sequential overhead perspective views of a golfer using the golf swing training board of FIG. 1.
Figure 4:
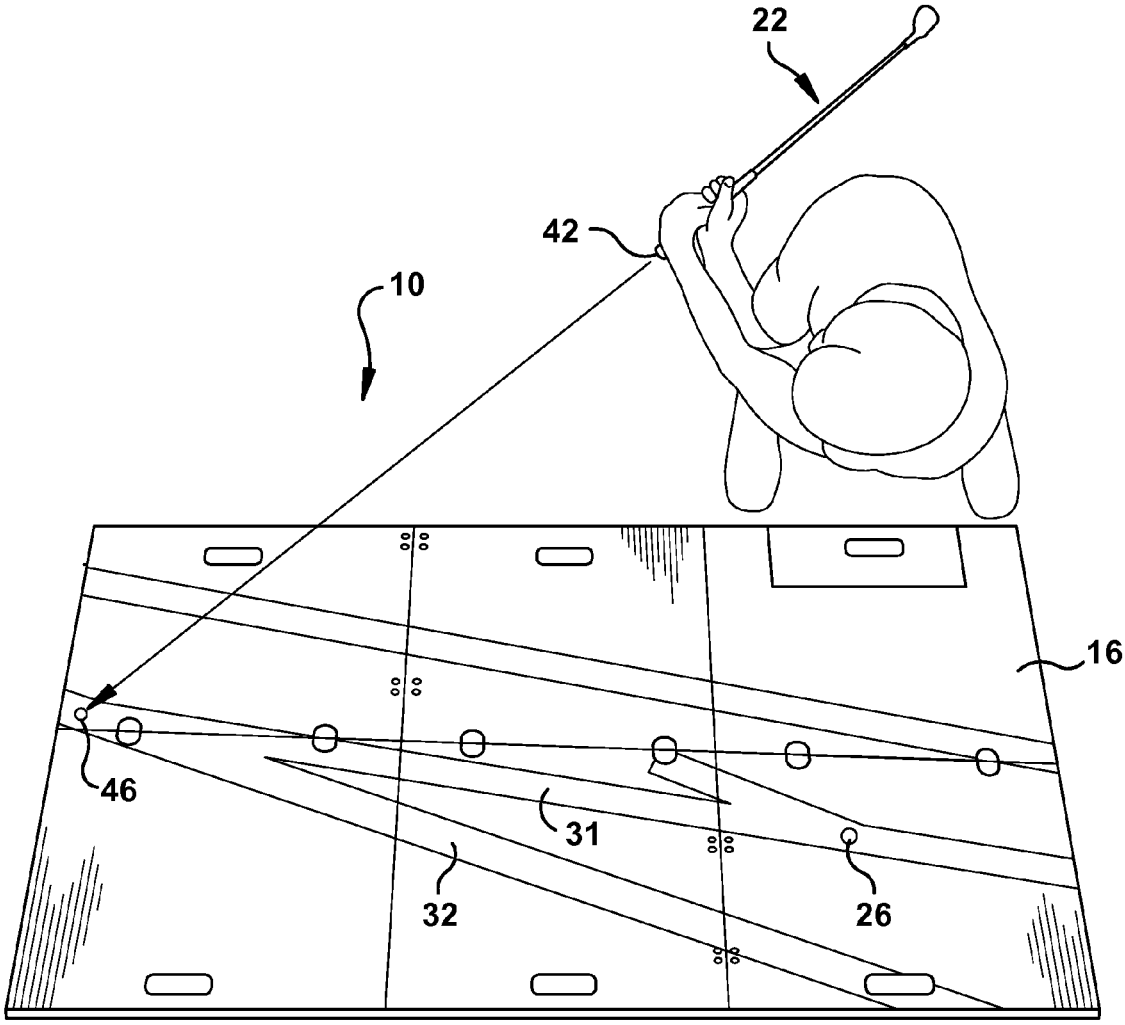

As the golfer starts his backswing, he moves the clubhead 24 along the first line 31, as shown in FIGS. 2 and 3, away from the ball 26. Then as the clubhead rotates upward, the butt or grip end of the shaft 25 rotates to point down and the light also follows the first line 31. When the light reaches another mark 46 along the first line 31 the golfer should be at the top of his backswing, ready to begin the downswing toward the ball. This also is illustrated by FIG. 4.

Figure 5:
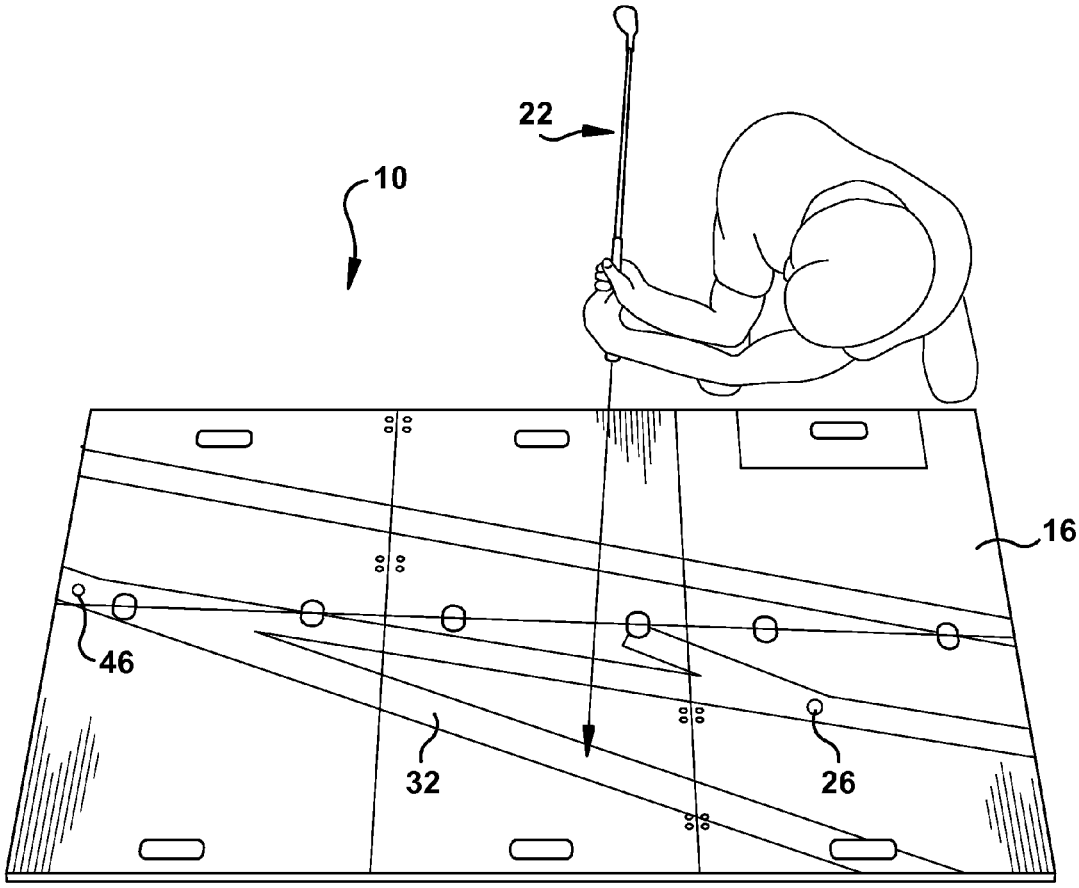

As the golfer begins the downswing, the light should proceed from the top-of-the-swing mark 46 and follow the second line 32 as shown in FIG. 5. The second line 32 extends away from the golfer and is inclined relative to the first line 31 at an angle of about ten to sixty degrees, and more particularly about twenty to thirty degrees. In a simplified system, the second line 32 can be omitted, even though that could reduce the feedback for the golfer to remain on plane during a portion of the downswing.

Figure 6:
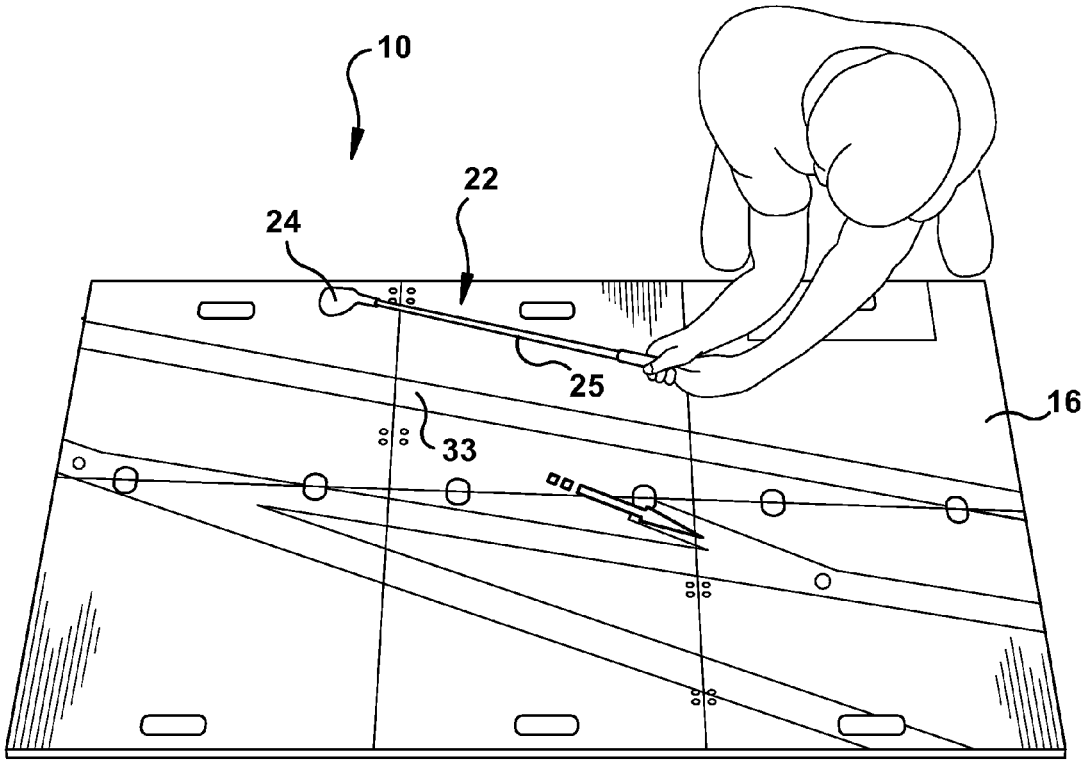

At approximately the midpoint of the downswing, see FIG. 6, when the club shaft 25 is parallel to the ground, the shaft 25 also should be parallel to the third line 33. The golfer can stop at this point and check the alignment of the shaft 25 with this third line 33.

Figure 7:
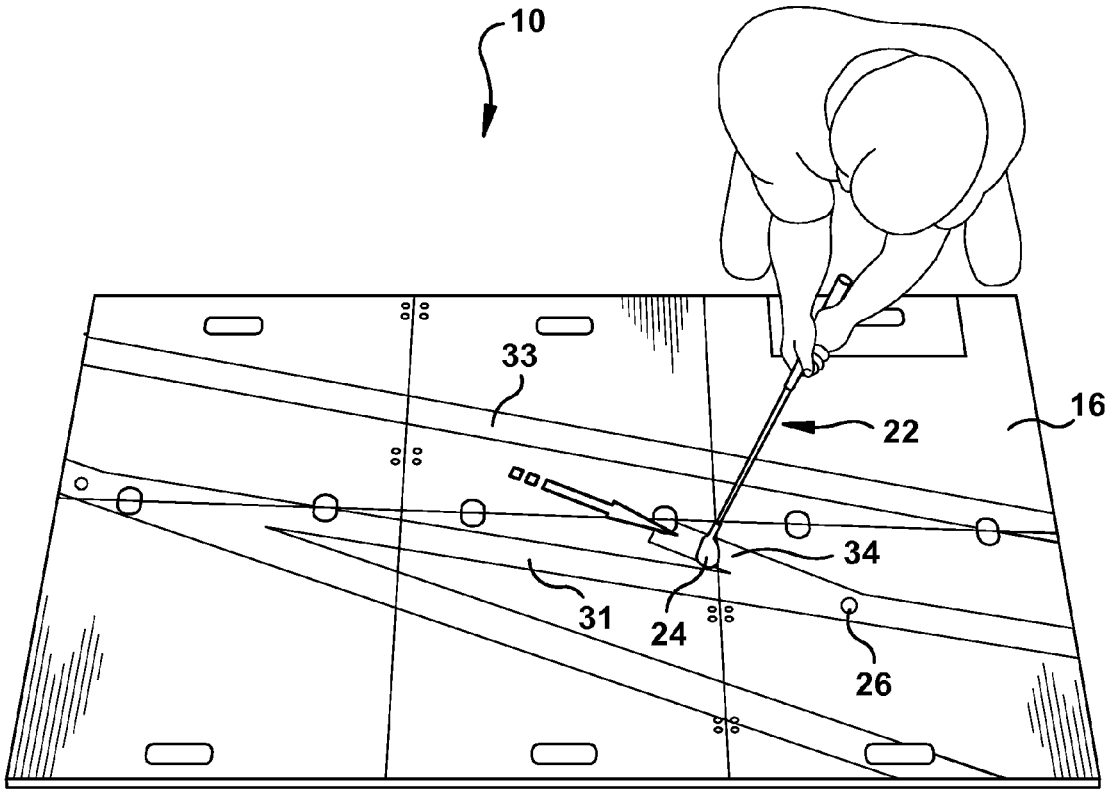

As the golfer continues his downswing, the clubface will travel down the fourth line 34, as shown in FIG. 7. The plane of the clubface generally should be square to the intended target path as the clubhead moves through the impact position at the ball mark 26. The fourth line 34 could be extended to the edge of the board or stopped short of the third line 33, as shown in the illustrated embodiments. Because a golfer will naturally move the club from the horizontal position parallel to the third line 33 to impact with the ball 26, the fourth line 34 can be omitted in a simplified system.

By following this procedure the golfer should always be on plane or square at impact. The face of the club will be perpendicular to the first line 31, which is aligned with the direction in which the golfer wants to hit the ball.

In an exemplary board 16, the board has a surface color and the various markings are machined in the board to reveal a secondary color below the surface. This means that the markings cannot peel, delaminate, or otherwise come off the board, which makes it more durable and longer-lasting.

In following the various paths marked on the board with the clubhead 24 and the light, the markings provide a visual indicator of whether the club 22 is on plane, even during the portions of the swing where the golfer is not in the best position to see the club itself. With repetition, the golfer will hit the ball more consistently and avoid swing mistakes, while developing improved clubhead speed, and improved impact and stability.

Figure 8:
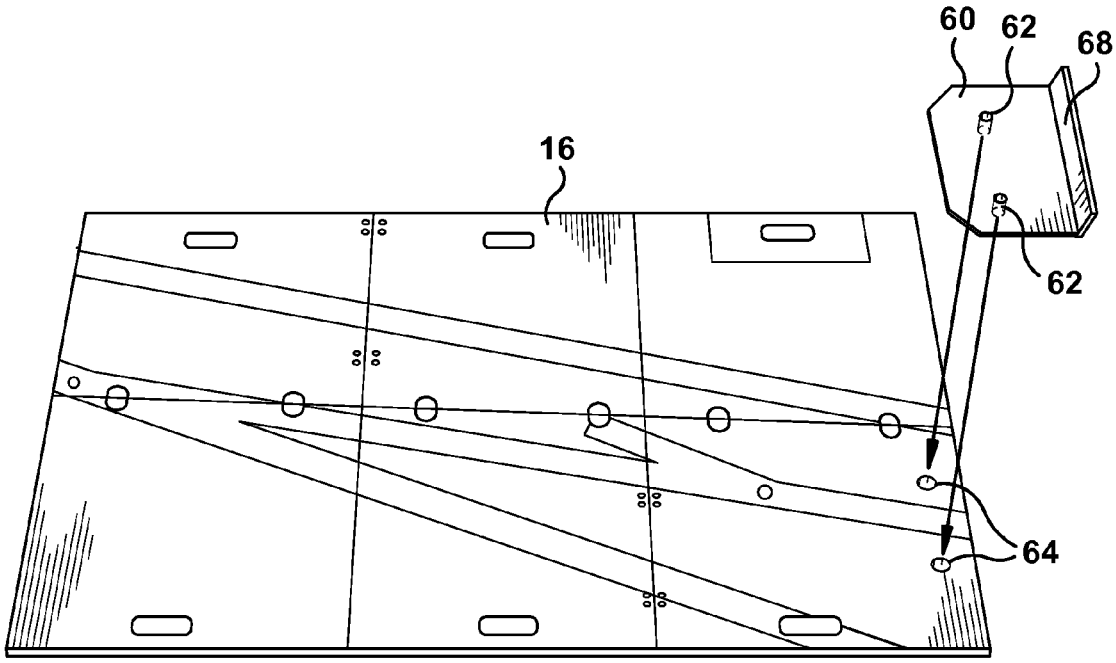
FIG. 8 is a perspective view of the golf swing training board of FIG. 1 and an accessory attachment.
Figure 9:
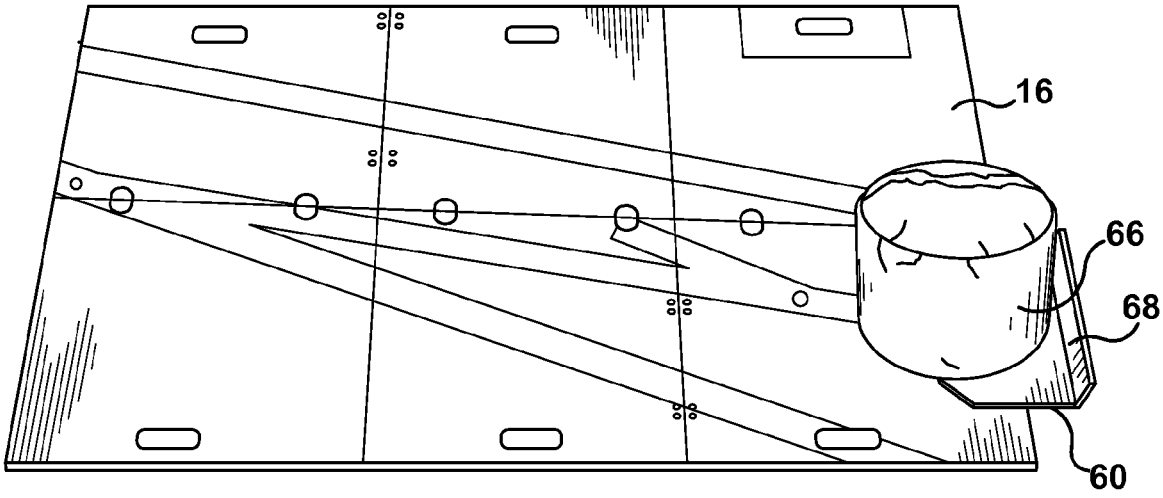
FIG. 9 is a perspective view of the golf swing training board and accessory of FIG. 8 as used with an impact bag.

In the illustrated training system 10, the training board 16 can be provided with means for attaching other training devices to the board. As shown in FIGS. 8 and 9, for example, a shelf 60 can be attached using locating pins 62 and corresponding holes 64 in the board 16 and shelf 60. The shelf 60 can support an impact bag 66, for example. Thus the illustrated shelf 60 includes a backstop 68 to help keep an impact bag in place. Other training accessories could be provided as well or in addition to the shelf.

Finally, as I mentioned the illustrated training board 16 can be folded up, making it easier to store and transport. Each segment 18 of the board 16 includes a cut-out handle 70, and all of the handles 70 align when the segments 18 are folded up. Each panel is connected to at least one other panel by one or more hinges 72. The hinges may be recessed into the surface of the board to help it fold up into a smaller, more compact configuration.

Figure 10:
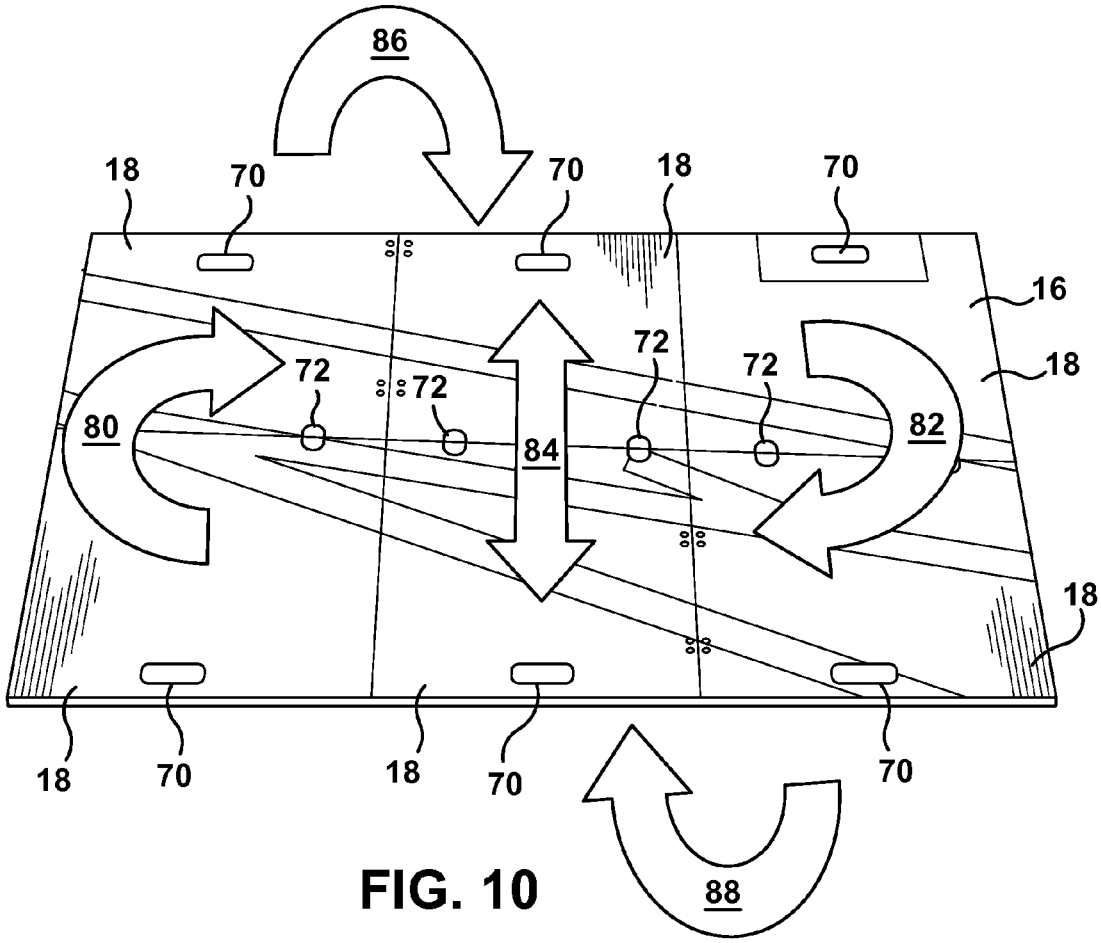
FIG. 10 is a schematic view of a portable golf swing training board in accordance with the present invention.
Figure 11:
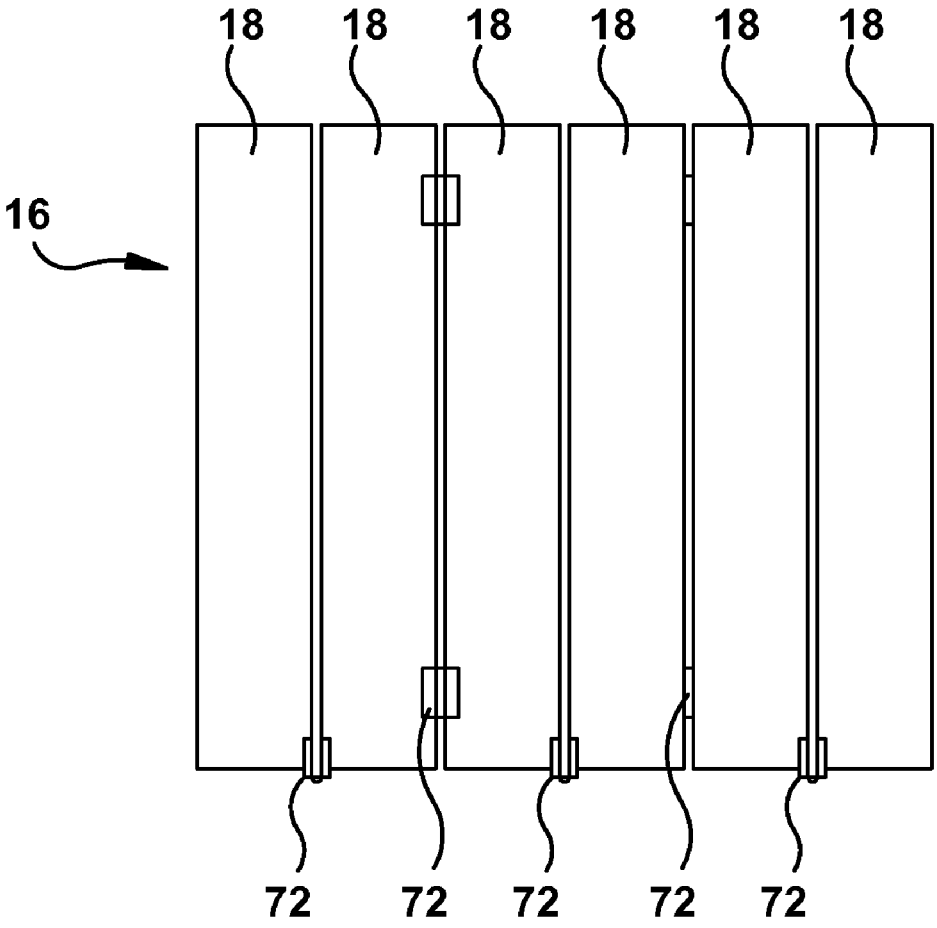
FIG. 11 is a side view of the portable golf swing training board of FIG. 10 in a compact folded state.

One folding arrangement is shown in FIGS. 10 and 11. First diagonally opposite panels are free to fold over to opposite sides of a center line, as represented by arrows 80 and 82. Next, the center panels, and the panels attached thereto can be folded about the center line, represented by arrow 84. And finally the outside panels can be folded against the inner panels, represented by arrows 86 and 88, to achieve the folded configuration shown in FIG. 11. Because the cut-out handles 70 align in the folded configuration, the entire board can be picked up with one hand. A different arrangement of hinges, a different number of panels, use of different materials, etc. can be used to create a different fold arrangement.

In summary, an exemplary golf swing training system and method includes a golf club, a light connected to or incorporated in the golf club, and a graphical display upon which a light is projected when a golfer swings the club. The graphics include various markings that can be observed to generate the desired golf swing. The golfer moves the clubhead and then the light along a first line until the light reaches a point at the top of the golfer's backswing. As the golfer begins the downswing, the light travels down a second line and the golfer brings the clubhead down a fourth line to impact the ball on plane and square to the target line. A third line can provide a visual indication of the orientation of the club shaft at a midpoint of the downswing, when the shaft is parallel to the ground, and other markings indicate foot position.

The board also is foldable into a compact configuration for transport and storage, and can be used with other training accessories.

Figure 12:
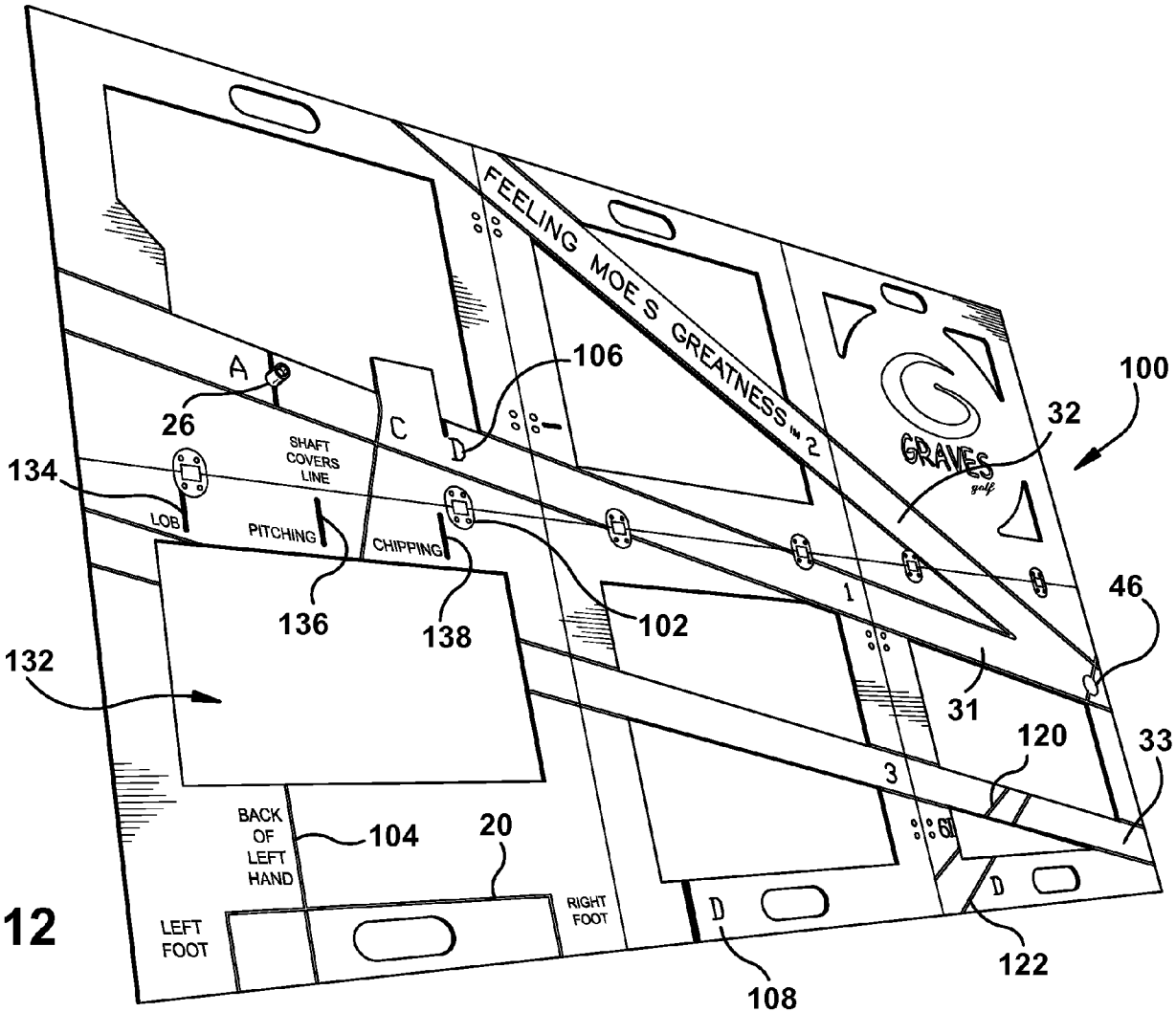
FIG. 12 is a perspective view of a variation of the portable golf swing training board provided by the present invention.
Figure 13:
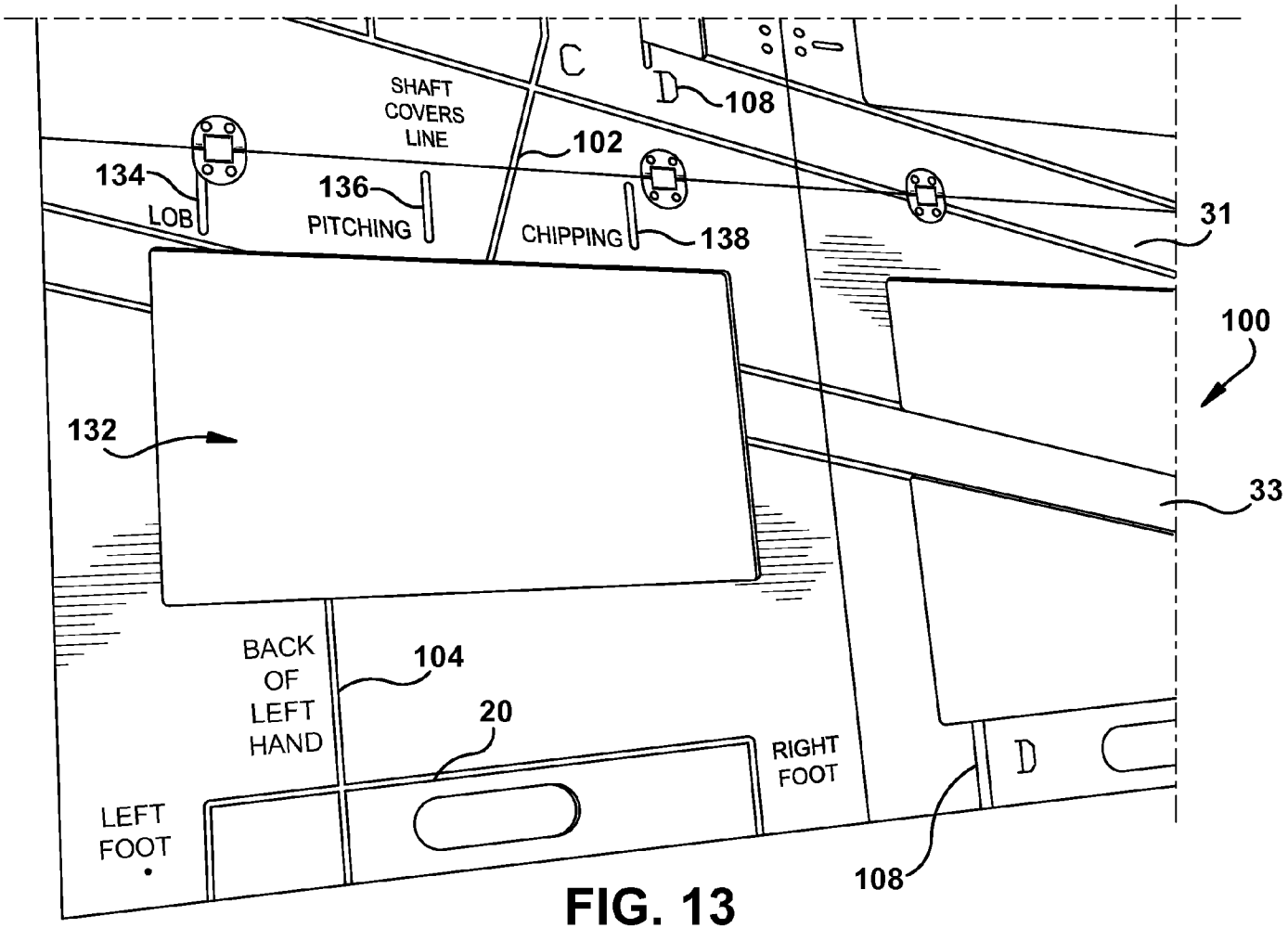
FIG. 13 is an enlarged view of a portion of the training board of FIG. 12.

FIGS. 12 and 13 show another version of the golf training board 100 that is substantially similar to the golf training board 16, but includes some different features. The training methods provided by this invention also can be practiced using this training board 100. Like the golf training board 16, the training board 100 includes markings to identify the path of the clubhead 24 along a first line 31 from a mark C behind the ball (26), which can be set on a tee at mark A (26), toward a top-of-the-swing mark B (46) further back along the first line. The training board 100 also includes a second line 32 and a third line 33, similar to board 16. Unlike board 16, however, this board 100 does not include a fourth line 34 (FIG. 1). When the golfer moves the club 22 from the position associated with the third line 33 to impact the ball 26 at A with the clubhead, the position of the ball 26 can be sufficient for the golfer to make contact along the appropriate line.

Note also that this board 100 includes several additional markings to help the golfer set up at the address position correctly. Not only does the clubhead get placed at C and the golfer's feet spaced outside the box 20 at the edge of the board, but markings have been included to specify where the left foot and right foot should be placed, a line 102 has been added to indicate where the shaft 25 of the club should lie at address, and a line 104 has been added to indicate the vertical plane behind which the back of the golfer's lead hand (in this case the left hand) should lie.

This training board 100 is designed for a golfer to use a golf club called an iron, particularly one with the length and angled clubface (the club's loft) to be a six-iron. But the board 100 also includes marks for a golfer working with the longest club, the driver. When using the driver, the golfer will put the ball in the same spot at A (26) and will start the clubhead at mark D (106). The golfer also will spread his feet farther apart, such as by moving the right foot from the mark indicated for the right foot to the mark D (108) spaced to the right of the right foot mark.

And finally, lines have been added to indicate the vertical plane on which the shaft 25 of the club should lie when the club points at the mark B (46) at the top of the backswing, including lines for both for a six-iron 120 and for a driver 122. When the club points at mark B, the face of the clubhead will parallel another line 124 through mark B.

The training board 100 has portions of each of the six segments 18 cut out or otherwise removed to make the board 100 lighter and more readily portable. One cut-out portion 132 in the board 100 is sized to receive a mat for practicing short range lob, pitching and chipping swings. Appropriate markings have been added to indicate where the golfer should place the ball for a lob shot 134, a pitching shot 136, and a chipping shot 138.

Figure 14:
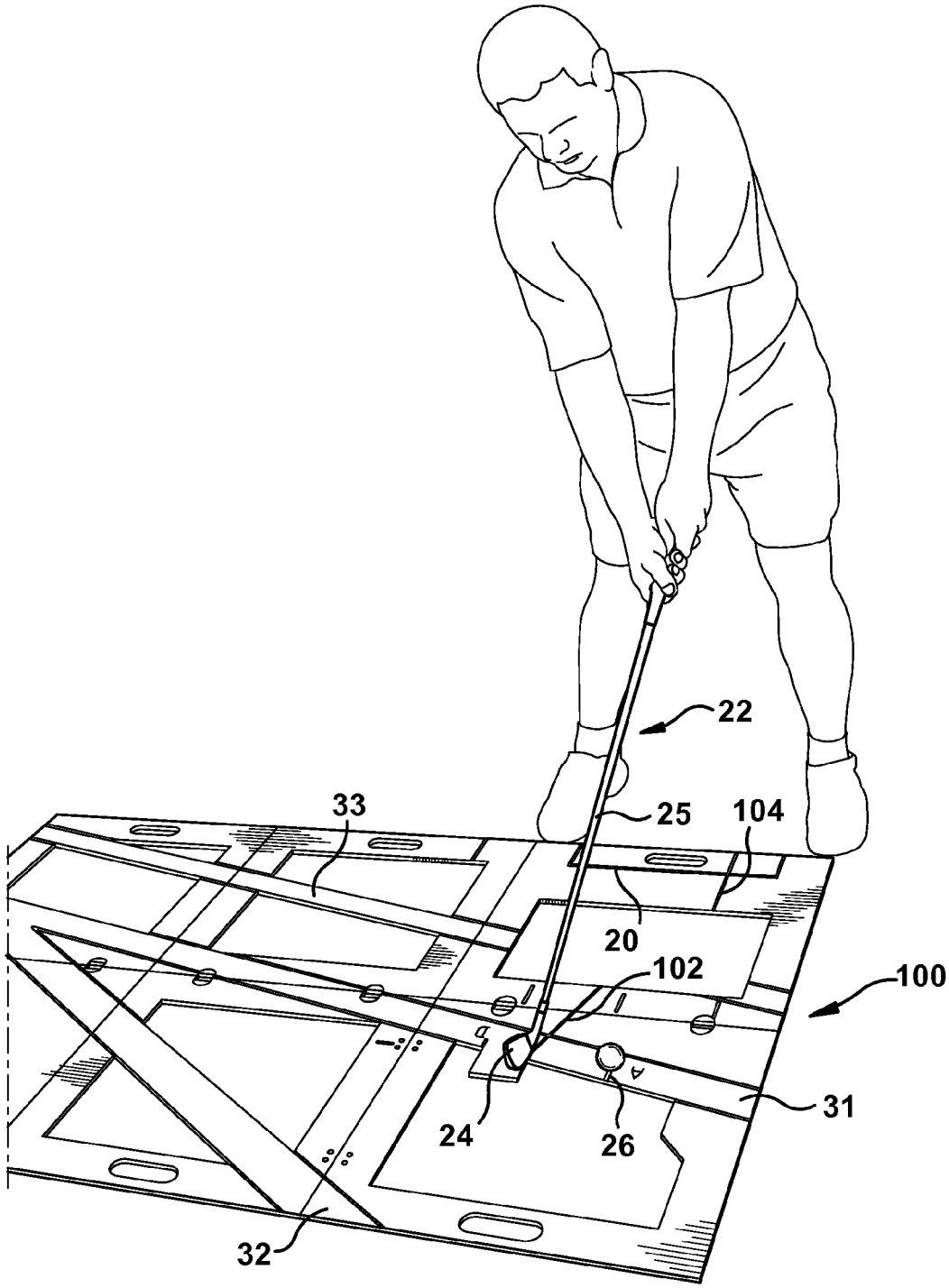
FIG. 14 is a perspective view of a golfer at a setup or address position relative to the training board of FIG. 12 looking across the training board toward the golfer.
Figure 15:
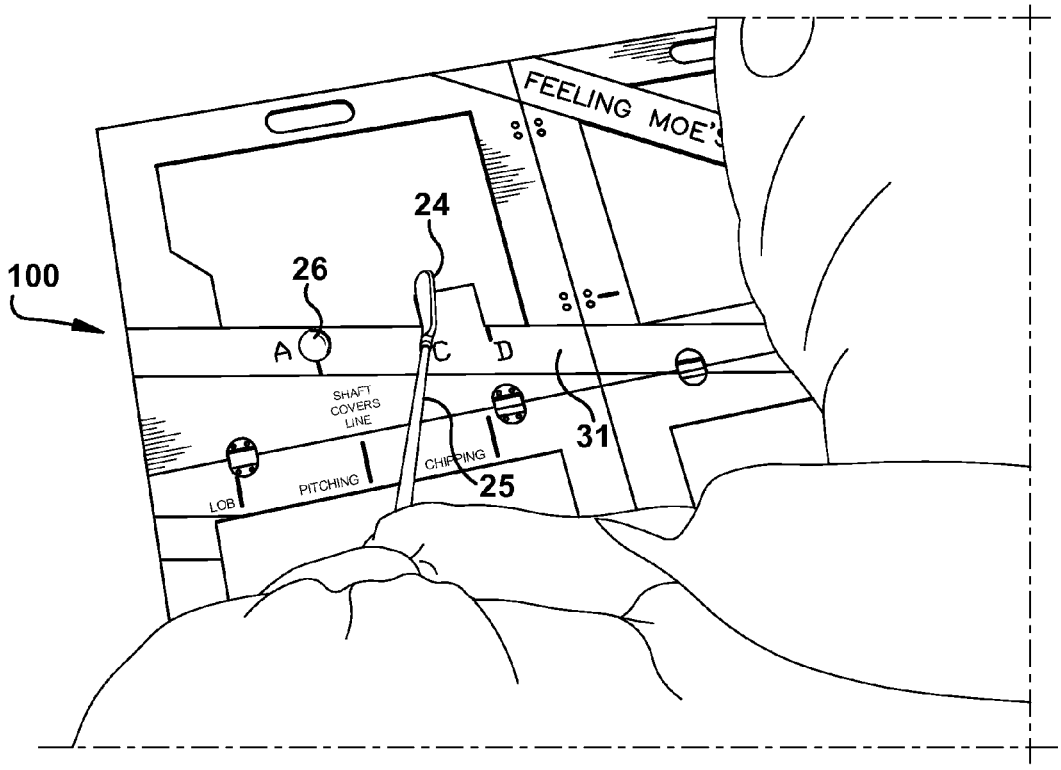
FIG. 15 is a perspective view of the scene in FIG. 14 looking over the golfer's shoulder toward the training board.

If you will look at FIGS. 14 and 15, you can see how a golfer would set up at address using the board 100. The golfer's feet are spaced on either side of the box 20, the clubhead 24 is positioned at mark C, and from the golfer's point of view the shaft 25 lies in the vertical plane at line 102, the shaft 25 covering up the line for the golfer. These markings allow the golfer to check that he is in the correct position at address.

Figure 16:
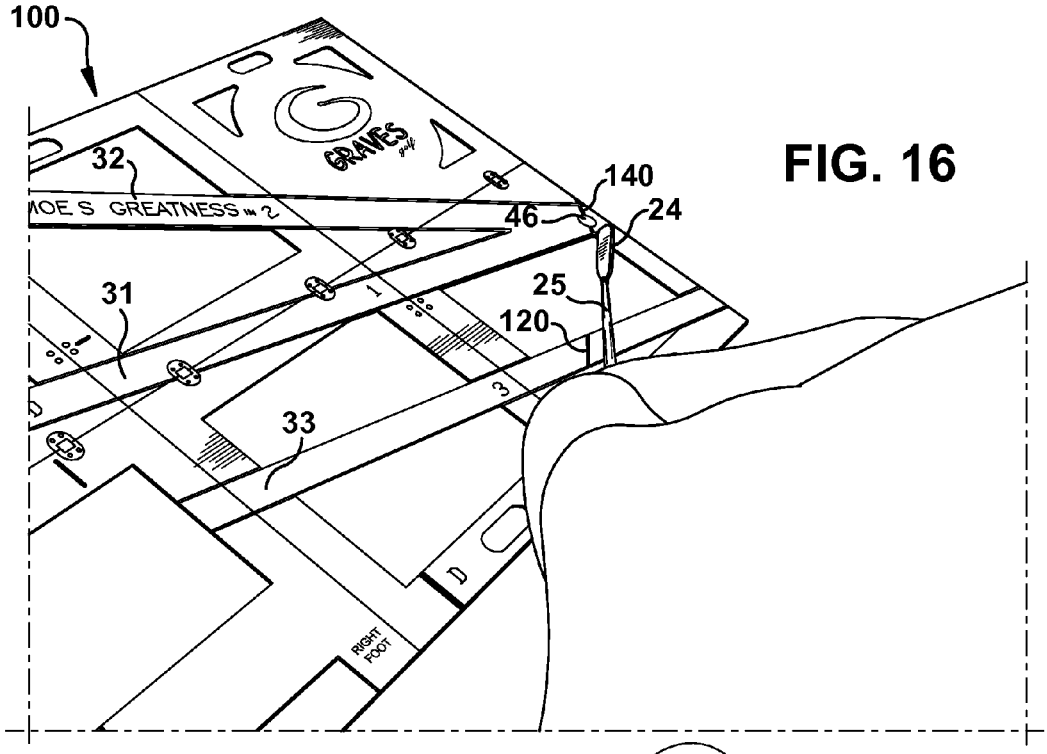
FIG. 16 is a perspective view looking over a golfer's shoulder at a checkpoint along the backswing.
Figure 17:
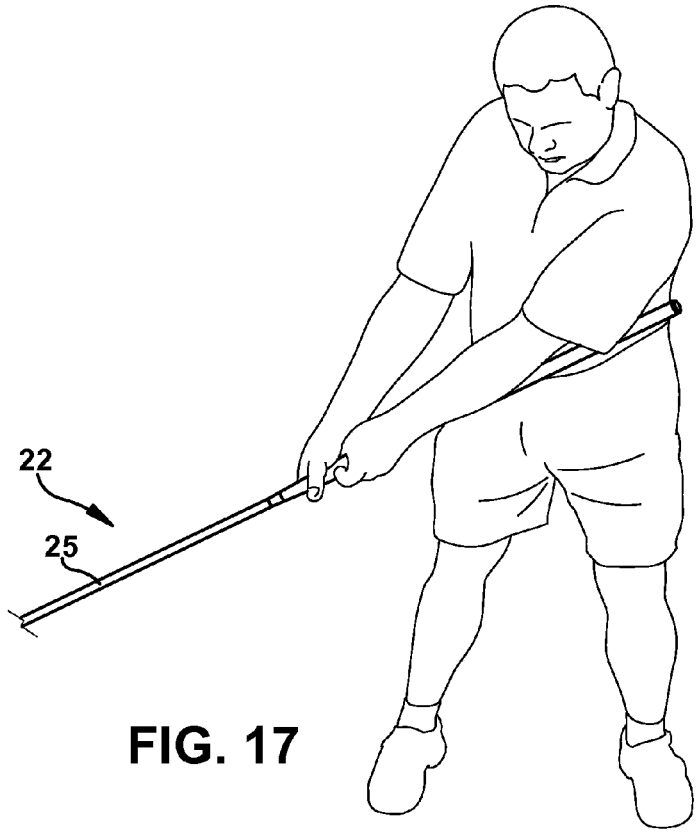
FIG. 17 is a front perspective view of the golfer in the scene shown in FIG. 16.
Figure 20:
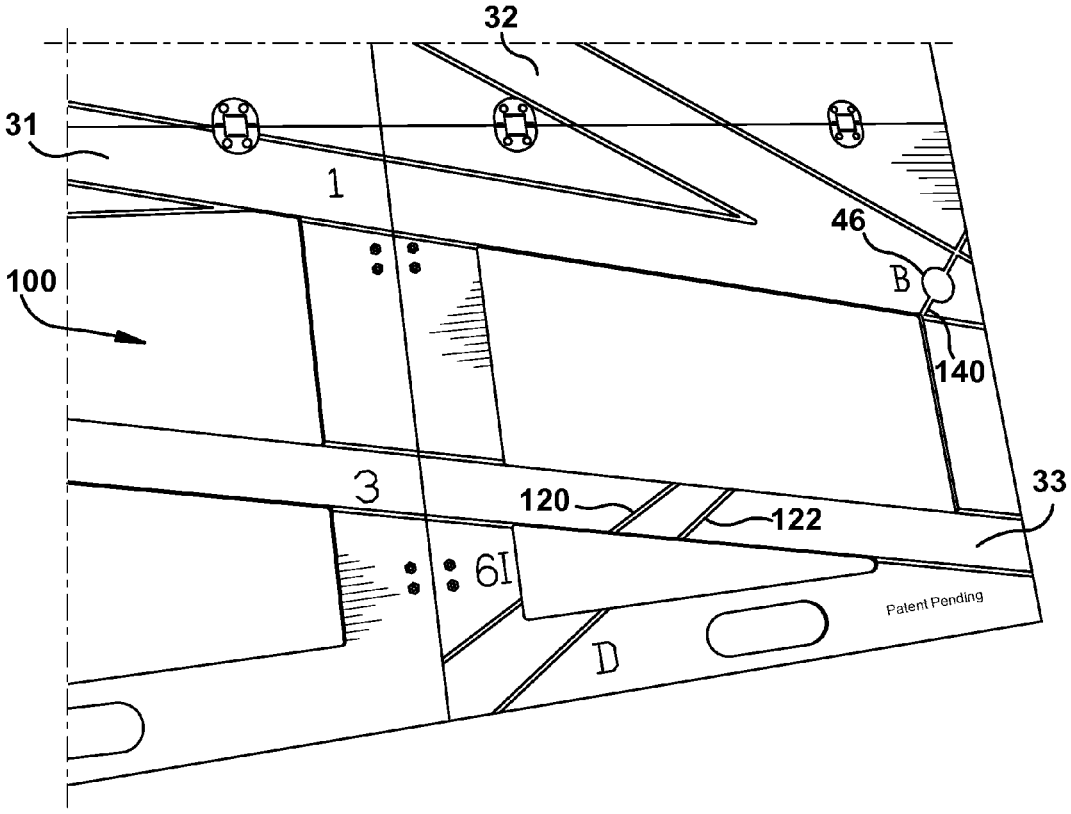
FIG. 20 is an enlarged view of another portion of the training board of FIG. 12.

As the golfer begins the backswing, the golfer will point the club 22 at the back mark 46, the shaft will cover up the line 120, and the clubface will be aligned with the line 140 at mark B (46), as shown in FIGS. 16 and 20. In FIG. 17, the golfer is in the same position as in FIG. 16. Again, these markings allow the golfer to check his position and to determine whether he is taking the clubhead back on-plane.

Figure 18:
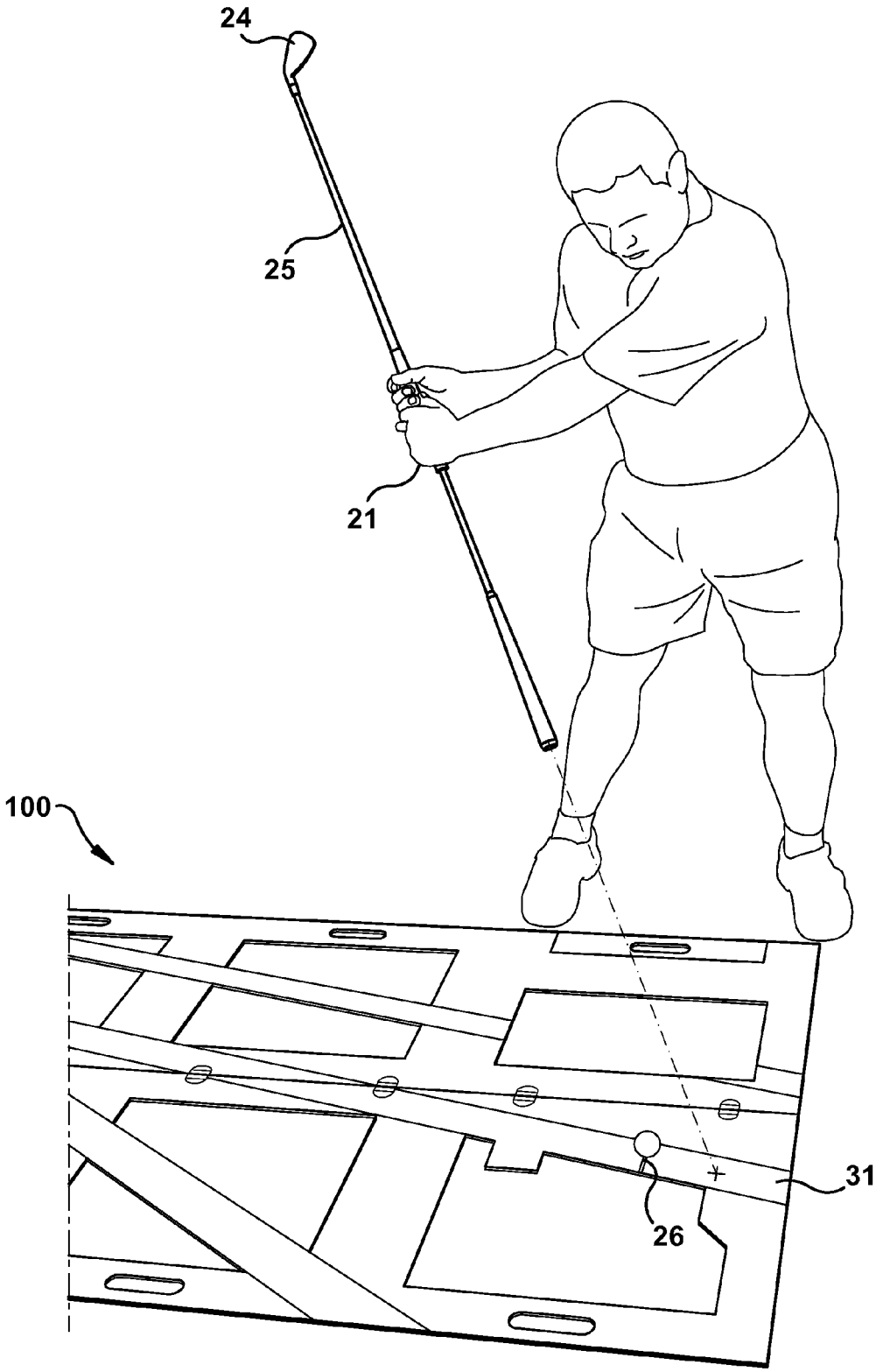
FIG. 18 is a front perspective view of a golfer and the training board at another checkpoint along the backswing.

As you can see in FIG. 18, as the golfer continues the backswing, the butt end 21 of the club will point to the first line 31. The golfer in FIG. 18 is using a shaft extension 141 rather than a laser, and the shaft extension helps the golfer keep the butt end 21 of the club aligned with the first line 31 while the clubhead 24 is rotated above the butt end of the club, just as with a laser.

Figure 19:
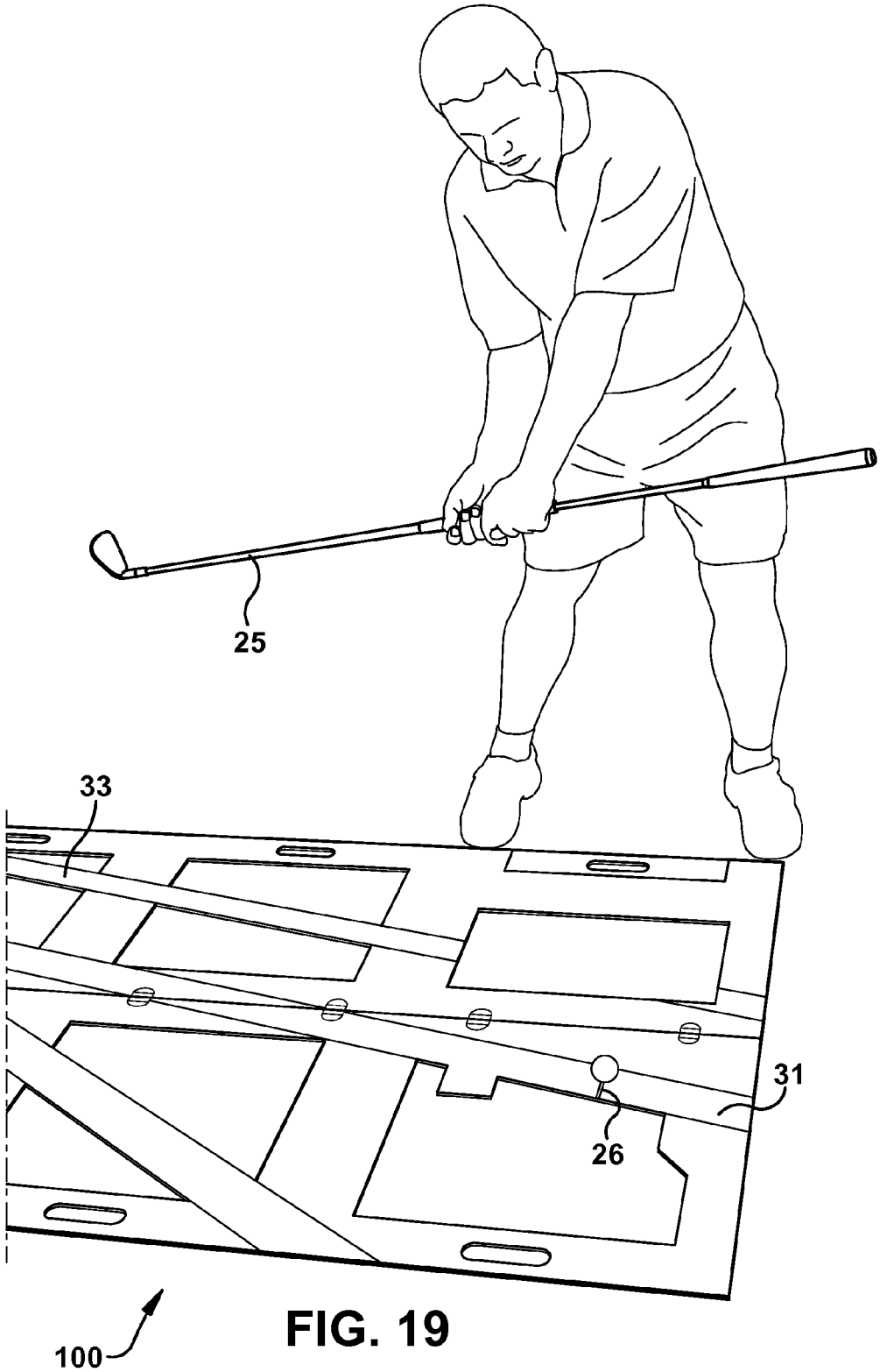
FIG. 19 is a front perspective view of a golfer and the training board at a checkpoint along the downswing.
Figure 21:
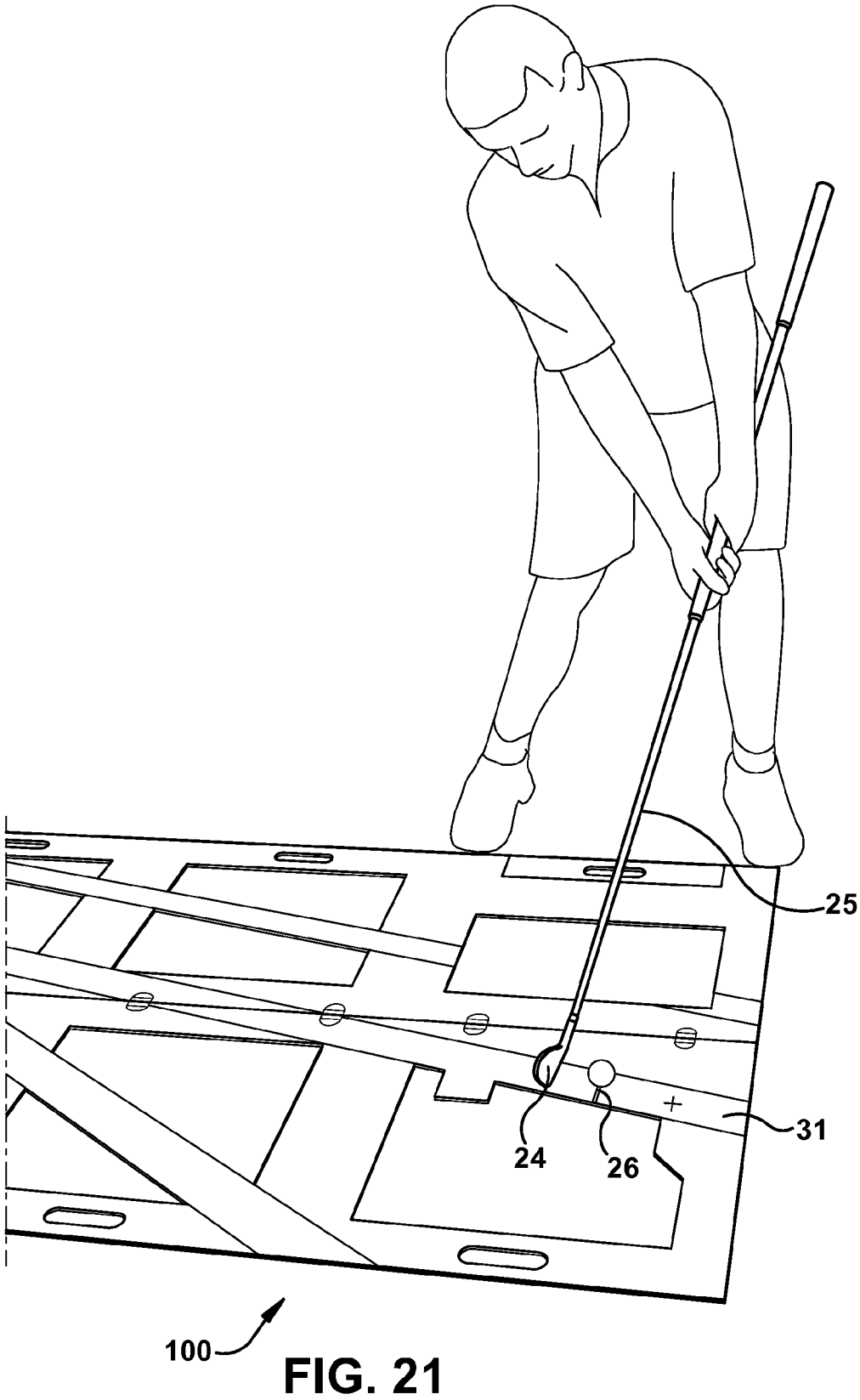
FIG. 21 is a front perspective view showing a golfer's position relative to the training board just before impact.
Figure 22:
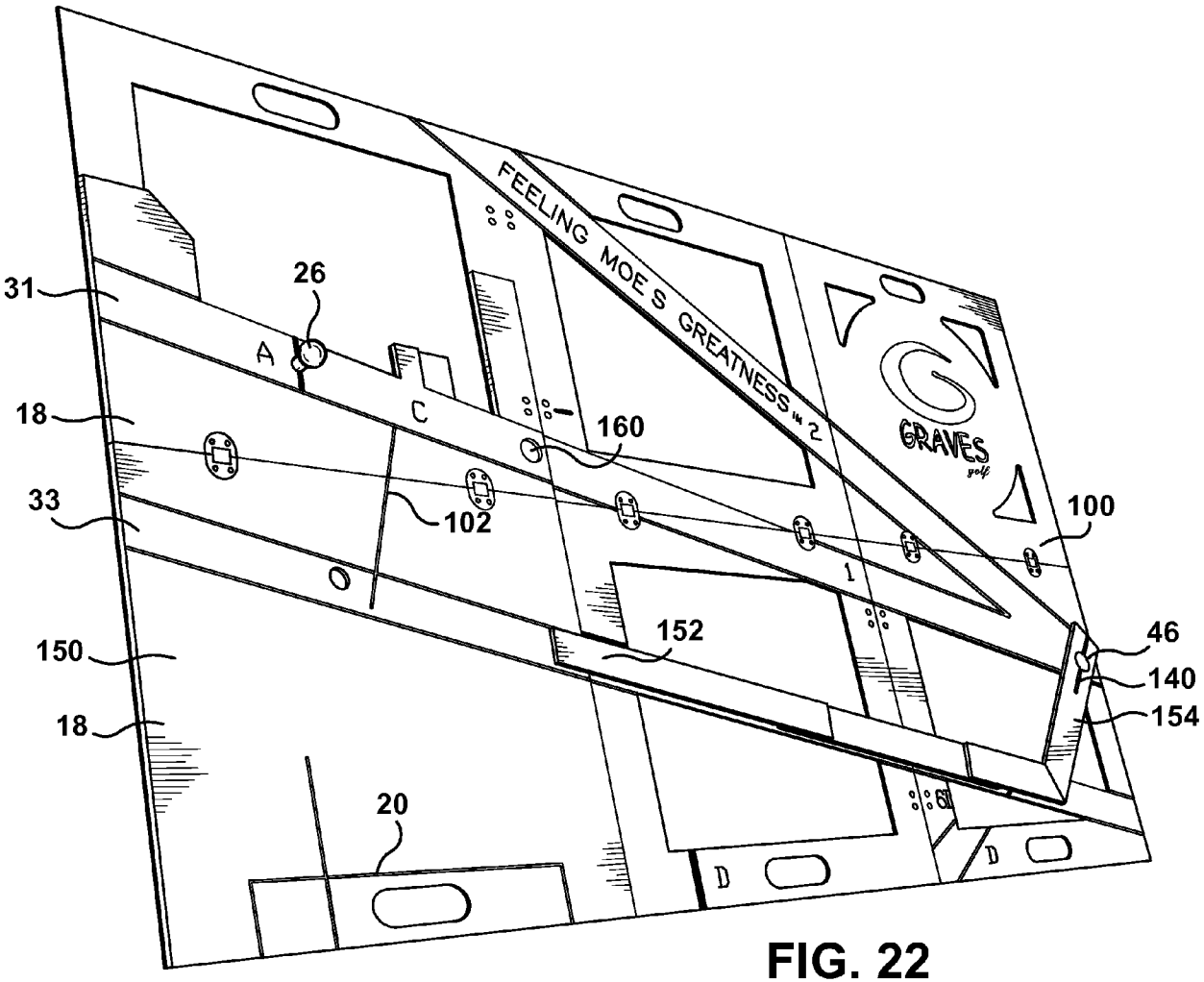
FIG. 22 is a perspective view of the training board of FIG. 12, with a smaller, simplified embodiment of the invention overlaid on top of it.
Figure 23:
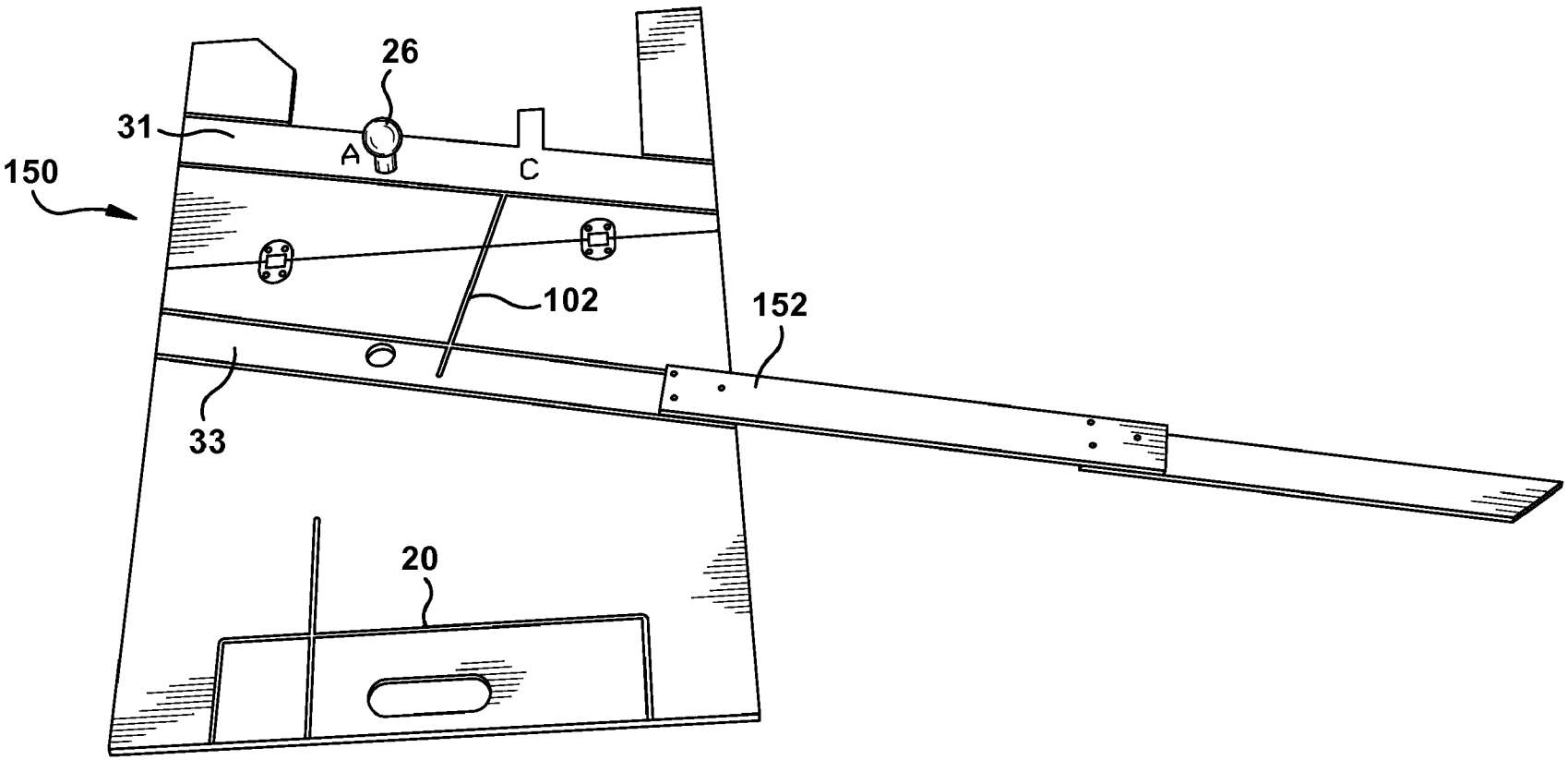
FIGS. 23-25 are sequential perspective views of another relatively smaller training board similar to the simplified training board shown in FIG. 22 showing the sequence of steps in folding the smaller training board into a compact configuration.
Figure 24:
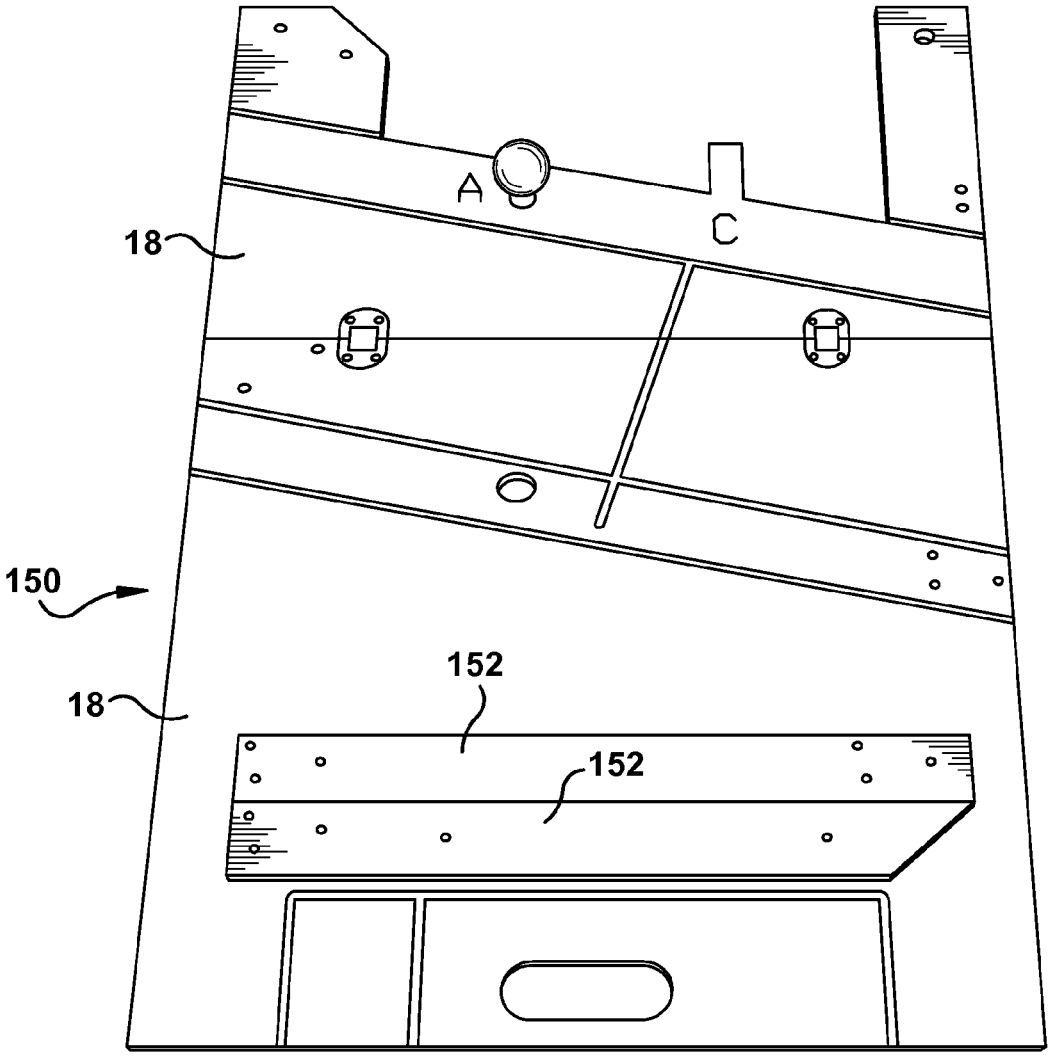
Figure 25:
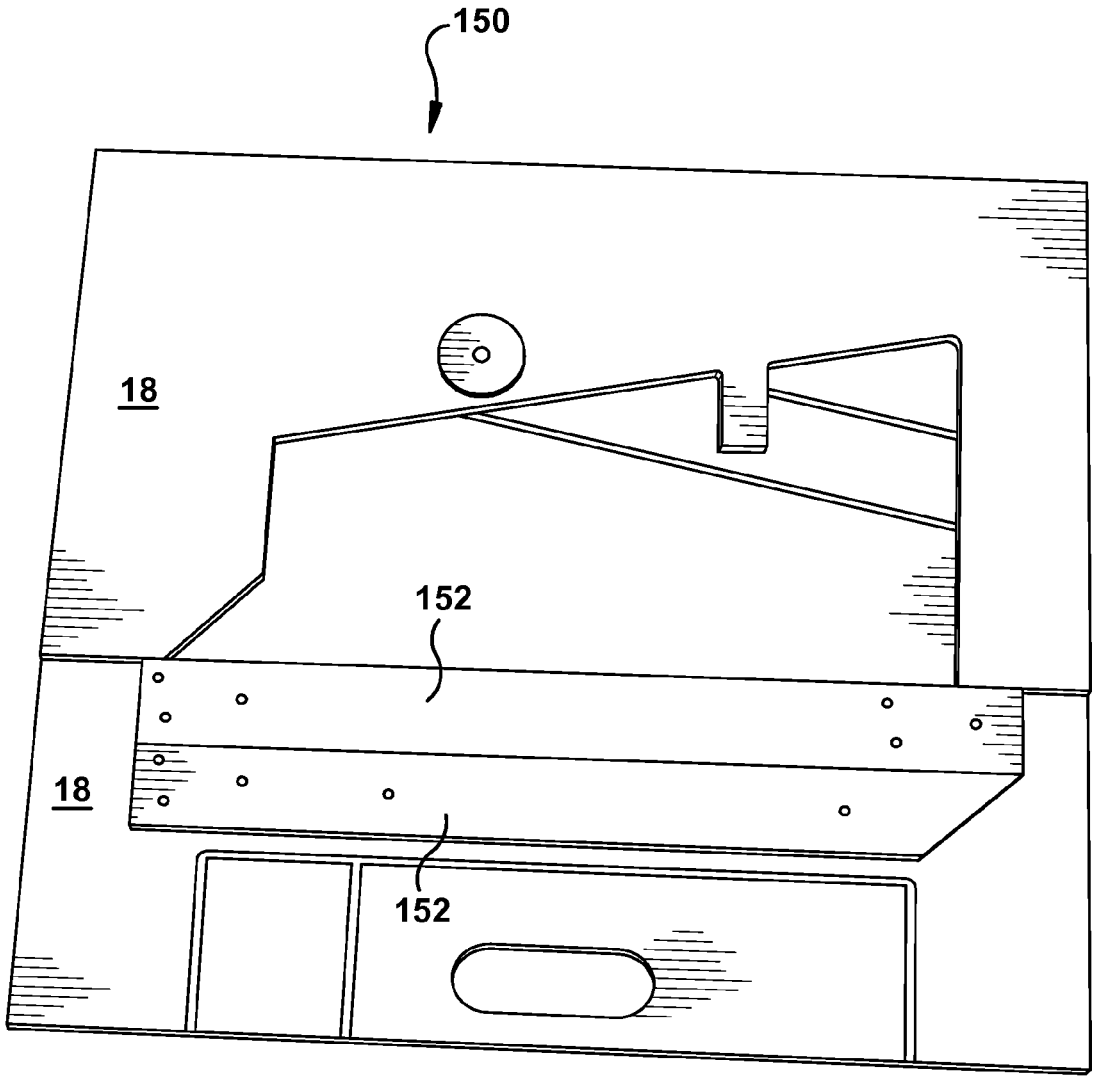

In FIG. 19, the golfer has begun the downswing and the club is approximately horizontal. At this position the golfer can again check that the club is still on plane by checking to see whether the shaft 25 is parallel to the third line 33. An enlarged view of this part of the board 100 is shown in FIG. 20. As the golfer continues the downswing, he will bring the clubhead 24 into contact with the ball 26, as shown in FIG. 21. Ideally, the golfer will reach the impact position with the hands ahead of the clubhead, as shown. Using this golf training board 100, over time the repetition will help the golfer make a consistent golf swing that keeps the club on plane throughout the swing, and most importantly, at impact with the golf ball.

Another exemplary method provided by the invention can be performed with the training system 10 described above, or with a different training board 150 shown in FIGS. 22-25. This training board 150 is shown overlaying the training board 100 just described. The training board 150 has two segments 18 that are similar to the two segments of the larger training board 100 in the area where the golfer stands at the address position. Instead of the other four segments, however, this training board 150 includes an extension 152 along the third line 33, and also can include a foot 154 that provides a place for the mark 46 along the first line 33.

Like the previous system, this smaller board 150 also can be folded into a compact configuration for travel. The extensions 152 that form the third line 33 can be disassembled or telescopically collapsed into the board 150. Mounting pins and corresponding holes are one way to store disassembled pieces for transport. The remaining segments 18 of the board 150 can be folded up and secured in place, such as with a hook-and-loop strap.

This board 150 does not include either the second line 32 or the fourth line 34 found on the board 16 (FIG. 1). The reason is that it is intended to be used for a different practice method.

Having all of the body parts in the proper position at impact requires practice and timing, and the golf training board 150 and the following method also can be used to help the golfer become more consistent, staying on plane throughout the swing and getting his or her hands in the proper position at impact. This method also can be practiced on the larger boards 16 and 100.

One of the problems that this training board 150 and method solves is the golfer putting his forward arm and club shaft in a straight line before the clubhead makes contact with the golf ball on the downswing. Sometimes a golfer will even hinge his wrists forward, bringing the clubhead through impact with the ball before the hands move past the ball. If you extend the first line 31 to the target, and then imagine a plane through the ball and perpendicular to that first line 31, that is the impact plane. And to make contact with the golf ball on plane, the golfer's hands should move through the impact plane before the clubhead. Whether the arms and shaft are aligned, or the clubhead reaches the impact plane before the hands, either problem can make it much more difficult for a golfer to consistently square the clubface or remain on plane at impact. If the golfer can consistently bring his or her hands through the impact plane before the clubface reaches the ball, the golfer is much more likely to consistently hit the ball on plane and toward its intended target.

The following method solves this problem by providing a way for the golfer to practice bringing his or her hands through the impact plane before the clubhead. In this method, the golfer sets up before the board 150 as before, with the golfer's feet and the club positioned in the same way. For this practice method, the golfer does not take the clubhead as far back as in a typical swing, with almost the entire golf club above the golfer's shoulders. In this practice method, the golfer moves the clubhead along the first line 31, away from the ball 26, without changing the position of the arms or wrists, and turns his body until the shaft is aligned with the back mark 46 (point B) and parallel to the line 120. This lets the golfer check that the club is still on plane to that point.

Once the shaft points at the back mark 46, the golfer begins to "break" his wrists and rotate the clubhead upward. The golfer also continues to rotate his hands around his body, moving his back elbow inward, toward his body, and moving the forward arm back, toward the golfer's chest, as his hips and shoulders turn back. Ideally the golfer will keep the forward arm below the back shoulder. When the butt end of the shaft is pointed at the ball, the laser will shine on the ball 26 as the light moves along the first line 31. This tells the golfer yet again that he is still on plane.

The golfer continues to rotate the club as the laser moves to mark 160 on the first line 31, where the golfer stops and begins the downswing. Mark 160 is on the first line 31 approximately six to twenty-four inches behind the ball 26 and between the ball 26 and the back mark 46 that defines a top-of-the-swing position in the previous method. The golfer does not continue to rotate and move the laser to the top-of-the-swing mark 46 in this method. As the golfer starts the downswing, he is primarily moving only the arms and hands, and keeping the hands ahead of the clubhead. As before, the shaft of the club should be parallel to the third line 33 when the club is approximately horizontal, giving the golfer another point for feedback to check whether the club is still on plane. The golfer continues the downswing through impact with the ball, bringing his hands through the impact plane ahead of the clubface, which will be square to the target on the first line 31.

As an additional aid for this drill, the system can include an extension of the golf club shaft in place of or in addition to the laser, as mentioned briefly above. With the golfer at the initial or address position, the shaft extension passes under the golfer's front or lead arm (left arm for a right-handed golfer, right arm for a left-handed golfer) and against the golfer's body (see FIG. 14). As the golfer begins the backswing, the shaft stays against the body until the club points at the back mark 46 (B) to help the golfer keep his hands and arms from breaking prematurely (see FIG. 16). The extension does not factor into the rest of the backswing, although it may make it easier for the golfer to visually align the shaft with the ball and then at mark 160 at the top of the backswing without using a laser, as mentioned above. The extension comes into play again on the downswing, where if the golfer tries to turn his wrists and push the clubhead through the impact plane before his hands, the extension will hit the golfer in the side underneath the lead arm. This can help the golfer keep his hands out front, ahead of the clubface at impact, as shown in FIG. 21.

I will briefly describe how this method can be practiced using the shaft extension by referring again to FIGS. 14-21, with the understanding that this same method can be practiced with the training board 150 shown in FIGS. 22-25. Beginning with FIGS. 14 and 15, a golfer is shown in the address position holding a club with the clubhead 24 at position C, behind the ball, and the shaft 25 aligned with the line 102. As you can see, the golfer's arms and shoulders form a triangle.

To begin the backswing, the golfer brings the clubhead 24 back along the first line 31, keeping his arms and wrists in the same position as at address, maintaining the triangle. The golfer also turns his shoulders and hips as he brings the golf club back. The golfer continues to move the clubhead 24 along the first line 31 until the shaft 25 points at mark B (46) and the shaft 25 is aligned with the line 120, as shown in FIGS. 16 and 17. The golfer can check this alignment to confirm that the club is still on plane.

The golfer then begins to hinge his wrists to rotate the clubhead 24 upward until the butt end 21 of the club points to the ball 26 (FIG. 18) and then mark 160 (FIG. 21) behind the ball along the first line 31. This means that a straight line through the center of the shaft 25 passes through the ball 26 and then travels along the first line 31 to mark 160. This provides feedback that tells the golfer that he is still on plane. At this point the club is at the top position of this swing. The clubhead is now above the golfer's shoulders, but the butt end of the club and the golfer's hands are below the golfer's shoulders, with the lead hand is below the trailing shoulder.

The golfer then begins the downswing, moving the clubhead 24 back toward the ball 26. As the golfer begins the downswing, the wrists only move a little, primarily the arms move the hands downward.

When the shaft 25 is approximately horizontal, the shaft 25 should be parallel to the third line 33, as shown in FIG. 17, the same as in the method described above for a full swing. This is another check for the golfer to confirm that the club is still on plane. The golfer can then proceed to rotate the body and move the arms and hands through the impact plane ahead of the clubhead 24. This also forces the golfer to keep his back or trailing shoulder down, below the lead shoulder, through impact, as shown in FIG. 18. The lead shoulder is the shoulder nearest the target. At impact, the clubface will be square to the target line (the first line 31) and the golfer's hands will be ahead of the clubhead. Repeatedly practicing the drill provided by this method will help the golfer hit a golf ball more consistently even when not using the board 16 provided by this invention.

Although the invention has been shown and described with respect to certain illustrated embodiments, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiments of the invention. In addition, while a particular feature of the invention may have been described above with respect to only one of several illustrated embodiments, such a feature may be combined with one or more other features of the other embodiment, as maybe desired and advantageous for any given or particular application.

I claim:

1. A training device to develop a consistent golf swing, comprising:

a generally planar member having a graphical display with markings that indicate foot position, ball position, a path for a clubhead of a golf club during at least part of a backswing portion of the golf swing, a path to be followed by a line that extends from a shaft of the golf club away from the clubhead during at least part of a backswing portion of the golf swing, and a mark spaced from the ball position that indicates a particular point in the golfer's swing when aligned with the line extending from the shaft of the golf club, where the planar member includes means for attaching other training devices, where the other training devices includes an impact bag and a shelf with a support surface and a backstop to support the impact bag at a desired location relative to the markings.

* * * * *